US007484538B2

(12) United States Patent
Barratte

(10) Patent No.: US 7,484,538 B2
(45) Date of Patent: Feb. 3, 2009

(54) PAPERMAKER'S TRIPLE LAYER FORMING FABRIC WITH NON-UNIFORM TOP CMD FLOATS

(75) Inventor: Christine Barratte, Saint-Claude (FR)

(73) Assignee: Weavexx Corporation, Wake Forest, NC (US)

( * ) Notice: Subject to any disclaimer, the term of this patent is extended or adjusted under 35 U.S.C. 154(b) by 111 days.

(21) Appl. No.: 11/513,590

(22) Filed: Aug. 31, 2006

(65) Prior Publication Data

US 2007/0062598 A1 Mar. 22, 2007

Related U.S. Application Data

(60) Provisional application No. 60/719,675, filed on Sep. 22, 2005.

(51) Int. Cl.
*D03D 3/04* (2006.01)
*D21F 7/08* (2006.01)
*D03D 25/00* (2006.01)

(52) U.S. Cl. ..... 139/383 A; 162/358.2; 162/902; 162/903

(58) Field of Classification Search ..... 139/383; 162/900, 902, 903, 358.2; 442/203, 206, 442/207

See application file for complete search history.

(56) References Cited

U.S. PATENT DOCUMENTS 2,172,430 A 9/1939 Barrell
2,554,034 A 5/1951 Koester et al.
3,094,149 A 6/1963 Keily
3,325,909 A 6/1967 Clark
4,093,512 A 6/1978 Fleischer
4,182,381 A 1/1980 Gisbourne
4,244,543 A 1/1981 Ericson
4,289,173 A 9/1981 Miller
4,290,209 A 9/1981 Buchanan et al.

(Continued)

FOREIGN PATENT DOCUMENTS

DE 454 092 12/1927

(Continued)

OTHER PUBLICATIONS

Copy of International Search Report for PCT/US2004/008311.
International Search Report for PCT Appl. No. PCT/US97/18629.
Rule 132 Declaration of Robert G. Wilson (Jun. 26, 1997).
Warren, C.A., "The Importance of Yarn Properties in Wet-End Wire Construction," Seminar, The Theory of Water Removal, Dec. 12, 1979.
European Search Report for European Application No. 05 00 2306 dated Oct. 6, 2005.

*Primary Examiner*—Bobby H Muromoto, Jr
(74) *Attorney, Agent, or Firm*—Myers, Bigel, Sibley & Sajovec, P.A.

(57) ABSTRACT

A papermaker's fabric includes: a set of top machine direction yarns; a set of top cross machine direction yarns interwoven with the top machine direction yarns to form a top fabric layer; a set of bottom machine direction yarns; a set of bottom cross machine direction yarns interwoven with the bottom machine direction yarns to form a bottom fabric layer; and a plurality of stitching yarns interwoven with the top and bottom fabric layers. The yarns are interwoven as a series of repeat units. In each of the repeat units, each top cross machine direction yarn forms multiple paper side floats, and at least a first of the paper side floats passes over a first number of top machine direction yarns, and at least a second of the paper side floats passes over a second number of top machine direction yarns that differs from the first number by one.

25 Claims, 3 Drawing Sheets

U.S. PATENT DOCUMENTS 4,363,426 A 12/1982 Heinzl et al.
4,414,263 A 11/1983 Miller et al.
4,438,788 A * 3/1984 Harwood ..... 139/383
4,452,284 A 6/1984 Eckstein et al.
4,453,573 A * 6/1984 Thompson ..... 139/383
4,501,303 A 2/1985 Osterberg
4,515,853 A 5/1985 Borel
4,529,013 A 7/1985 Miller
4,564,052 A * 1/1986 Borel ..... 139/425
4,564,551 A 1/1986 Best
4,592,395 A * 6/1986 Borel ..... 139/383
4,592,396 A 6/1986 Borel et al.
4,605,585 A 8/1986 Johansson
4,611,639 A * 9/1986 Bugge ..... 139/383
4,621,663 A 11/1986 Malmendier
4,633,596 A 1/1987 Josef
4,642,261 A 2/1987 Fearnhead
4,676,278 A 6/1987 Dutt
4,705,601 A 11/1987 Chiu
4,709,732 A * 12/1987 Kinnunen ..... 139/383
4,729,412 A * 3/1988 Bugge ..... 139/383
4,731,281 A 3/1988 Fleischer et al.
4,739,803 A 4/1988 Borel
4,755,420 A 7/1988 Baker et al.
4,759,975 A 7/1988 Sutherland et al.
4,815,499 A 3/1989 Johnson
4,815,503 A * 3/1989 Borel ..... 139/383
4,909,284 A 3/1990 Kositzke
RE33,195 E 4/1990 McDonald et al.
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,152,326 A 10/1992 Vohringer
5,158,118 A 10/1992 Tate et al.
5,219,004 A 6/1993 Chiu
5,228,482 A 7/1993 Fleischer
5,277,967 A 1/1994 Zehle et al.
5,343,896 A * 9/1994 Schroder et al. ..... 139/383
5,358,014 A 10/1994 Kovar
5,421,374 A 6/1995 Wright
5,421,375 A 6/1995 Praetzel
5,429,686 A 7/1995 Chiu et al.
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,490,543 A 2/1996 Fujisawa
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,632,310 A 5/1997 Yasuoka
5,641,001 A 6/1997 Wilson
5,645,112 A * 7/1997 Lee ..... 139/383
5,651,394 A 7/1997 Marchand
5,709,250 A 1/1998 Ward et al.
RE35,777 E 4/1998 Givin
5,746,257 A 5/1998 Fry
5,826,627 A 10/1998 Seabrook et al.
5,857,498 A 1/1999 Barreto et al.
5,881,764 A 3/1999 Ward
5,894,867 A 4/1999 Ward et al.
5,899,240 A 5/1999 Wilson
5,937,914 A 8/1999 Wilson
5,967,195 A 10/1999 Ward
5,975,148 A * 11/1999 Lee ..... 139/383
5,983,953 A 11/1999 Wilson
6,073,661 A 6/2000 Wilson
6,112,774 A 9/2000 Wilson
6,123,116 A 9/2000 Ward et al.
6,145,550 A 11/2000 Ward
6,148,869 A 11/2000 Quigley
6,158,478 A 12/2000 Lee et al.
6,179,965 B1 1/2001 Cunnane et al.
6,189,577 B1 * 2/2001 Lee ..... 139/383
6,202,705 B1 3/2001 Johnson et al.
6,207,598 B1 3/2001 Lee et al.
6,227,255 B1 5/2001 Osterberg et al.
6,237,644 B1 5/2001 Hay et al.
6,240,973 B1 6/2001 Stone et al.
6,244,306 B1 6/2001 Troughton
6,253,796 B1 7/2001 Wilson et al.
6,276,402 B1 8/2001 Herring
6,379,506 B1 4/2002 Wilson et al.
6,581,645 B1 6/2003 Johnson et al.
6,585,006 B1 7/2003 Wilson et al.
6,837,277 B2 1/2005 Troughton et al.
6,926,043 B2 * 8/2005 Quigley et al. ..... 139/383
7,001,489 B2 2/2006 Taipale et al.
2003/0010393 A1 1/2003 Kuji
2004/0079434 A1 4/2004 Martin et al.
2004/0102118 A1 5/2004 Hay et al.
2004/0182465 A1 9/2004 John

FOREIGN PATENT DOCUMENTS

DE 3318960 A1 11/1984
DE 33 29 740 3/1985
EP 0 048 962 9/1981
EP 0 158 710 10/1984
EP 0 185 177 10/1985
EP 0 224 276 12/1986
EP 0 264 881 10/1987
EP 0 269 070 11/1987
EP 0 284 575 2/1988
EP 0 283 181 3/1988
EP 0 350 673 6/1989
EP 0 408 849 A2 5/1990
EP 0 408 849 A3 5/1990
EP 0 672 782 3/1995
EP 0 794 283 A1 9/1997
FR 2 597 123 4/1986
GB 2157328 10/1985
GB 2 202 869 A 10/1988
GB 2245006 2/1991
JP 8-158285 12/1994
WO WO 86/00099 1/1986
WO WO 89/09848 4/1989
WO WO 99/61698 5/1999
WO WO 02/00996 1/2002
WO WO 03/093573 A1 11/2003

* cited by examiner 31 21 22 23 24 25 26 27 28 29 30
61
20
51 52 53 54 55 56 57 58 59 60

41a 23 26 41b 30
53 58

111 101 102 103 104 105 106 107 108 109 110
100
131 121 122 123 124 125 126 127 128 129 130

101 103 106 108 141a
141b
123 128

214 201 202 203 204 205 206 207 208 209 210 211 212
234
200
221 222 223 224 225 226 227 228 229 230 231 232

201 204 206 209 211 241b
241a
223 229

311 301 302 303 304 305 306 307 308
300
331 321 322 323 324 325 326 327 328

301 304 306 341b
341a
322 326

PAPERMAKER'S TRIPLE LAYER FORMING FABRIC WITH NON-UNIFORM TOP CMD FLOATS

RELATED APPLICATION

This application claims priority from U.S. Provisional Patent Application Ser. No. 60/719,675, filed Sep. 22, 2005, the disclosure of which is hereby incorporated herein in its entirety.

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being-joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, some paper grades, particularly fine paper grades intended for use in quality printing, carbonizing, cigarettes, electrical condensers, and the like, and in some instances tissue paper grades, have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine mesh yarns on the paper forming surface to facilitate paper formation and coarser mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, and U.S. Pat. No. 5,437,315 to Ward.

One particularly desirable type of triple layer fabric is illustrated in U.S. Pat. Nos. 5,967,195 and 6,145,550 to Ward. The fabrics described therein include pairs of stitching yarns between adjacent top CMD yarns that alternately interweave with the top and bottom MD yarns of the fabric. They do so in such a manner that they integrate with and "complete the weave" of the weave pattern of the top MD and top CMD yarns. Such a papermaking surface can provide good fiber support, drainage and interlaminar wear resistance. Alternative fabrics of this type are illustrated in U.S. Pat. No. 5,826,627 to Seabrook et al. These fabrics typically have a plain weave surface (i.e., a surface in which an "over 1/under 1" pattern is followed by both MD and CMD yarns) and are used for fine paper grades. Unfortunately, plain weave fabrics may be susceptible to wear on the papermaking surface, particularly with the top CMD yarns because the single knuckles of a plain weave do not provide a great deal of surface area for wear. Longer CMD floats are typically avoided on the papermaking surface to reduce the tendency for the paper to suffer from diagonal marking.

In some instances, particularly instances in which the paper being made is a tissue paper grade, it may be desirable to produce a forming fabric that has increased wear properties but still provides many of the advantages of a triple layer fabric. A weave pattern that is relatively easily woven on available looms would also be desirable, as would a weave pattern that avoids marking.

SUMMARY OF THE INVENTION

The present invention is directed to papermaker's forming fabrics that can provide an adequate papermaking surface for certain grades of paper (such as tissue paper) with increased wear characteristics. As a first aspect, embodiments of the invention are directed to a triple layer papermaker's fabric comprising: a set of top machine direction yarns; a set of top cross machine direction yarns interwoven with the top machine direction yarns to form a top fabric layer; a set of bottom machine direction yarns; a set of bottom cross machine direction yarns interwoven with the bottom machine direction yarns to form a bottom fabric layer; and a plurality of stitching yarns interwoven with the top and bottom fabric layers. The top machine direction yarns, top machine direction yarns, bottom machine direction yarns, bottom cross machine direction yarns, and stitching yarns are interwoven as a series of repeat units. In each of the repeat units, each top cross machine direction yarn forms multiple paper side floats by passing over some of the top machine direction yarns and interweaving beneath a top machine direction yarn on each side of the float, and at least a first of the paper side floats passes over a first number of top machine direction yarns, and at least a second of the paper side floats passes over a second number of top machine direction yarns, and the difference between the first number and the second number is one.

As a second aspect, embodiments of the present invention are directed to a triple layer papermaker's fabric comprising: a set of top machine direction yarns; a set of top cross machine direction yarns interwoven with the top machine direction yarns to form a top fabric layer; a set of bottom machine direction yarns; a set of bottom cross machine direction yarns interwoven with the bottom machine direction yarns to form a bottom fabric layer; and a plurality of stitching yarn pairs interwoven with the top and bottom fabric layers. The top machine direction yarns, top machine direction yarns, bottom machine direction yarns, bottom cross machine direction yarns, and stitching yarns are interwoven as a series of repeat units. In each of the repeat units, each top cross machine direction yarn forms multiple paper side floats by passing over some of the top machine direction yarns and interweaving beneath a top machine direction yarn on each side of the float, the floats being non-uniform for each top cross machine direction yarn. Each stitching yarn pair forms a cross machine direction yarn unit having multiple paper side floats by passing over some of the top machine direction yarns and interweaving beneath a top machine direction yarn on each side of each float, the floats being non-uniform for each cross machine direction yarn unit.

As a third aspect, embodiments of the present invention are directed to a method of forming paper with the above-described fabrics. The method comprises the steps of: providing such a fabric; applying paper stock to the fabric; and removing moisture from the paper stock to form paper. In some embodiments, the paper stock is selected and applied such that the paper formed is tissue paper.

BRIEF DESCRIPTION OF THE FIGURES

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

The present invention will now be described more particularly hereinafter with reference to the accompanying drawings, in which embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

One aspect of the present invention is directed to triple layer papermaker's forming fabrics that include both a top fabric layer and a bottom fabric layer. These fabrics are "true" triple layer fabrics in that they include sets of MD yarns and CMD yarns that only weave in the top fabric layer, as well as sets of MD yarns and CMD yarns that only weave in the bottom fabric layer. The fabrics also include pairs of adjacent CMD yarns that together replace the equivalent of a single CMD yarn (i.e., they form a "CMD yarn unit") in the weave pattern on the papermaking surface. These yarns are woven such that when an upper portion of one yarn in the pair is weaving in the top fabric layer so as to complete the weave pattern on the papermaking surface, a lower portion of the second yarn in the pair weaves below the papermaking surface. Throughout the fabric, these yarns trade these positions.

The lower portion of at least one of the yarns in the pair also drops down to the bottom fabric layer at one or more points so as to bind the top and bottom fabric layers together. Herein, these yarn pairs are referred to as "stitching yarn pairs" (even in those embodiments in which only one yarn of the pair actually "stitches" with the bottom fabric layer). Individual yarns from these yarn pairs are typically referred to as "stitching yarns."

Also, as one yarn interlaces with one or more other yarns, the segment of yarn that passes over other yarns is called a "float". Typically, a float is identified by the number of yarns it passes over; e.g., one yarn passing over two adjacent yarns is a "2-yarn float" (a single yarn float is often also called a "knuckle").

Figure 1:
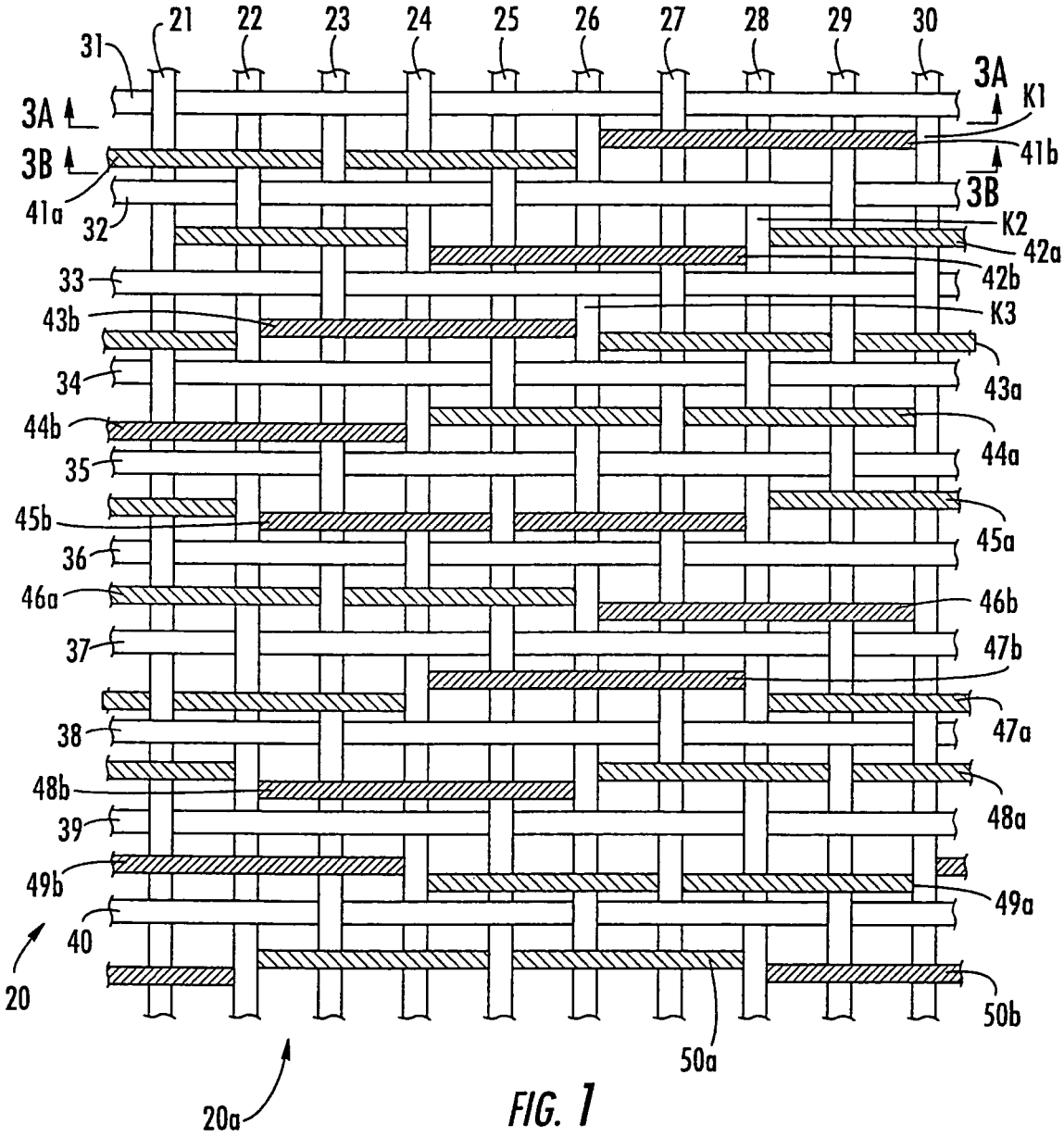
FIG. 1 is a top view of the papermaking surface formed by the top layer of a 20 harness papermaker's fabric according to embodiments of the present invention.
Figure 2:
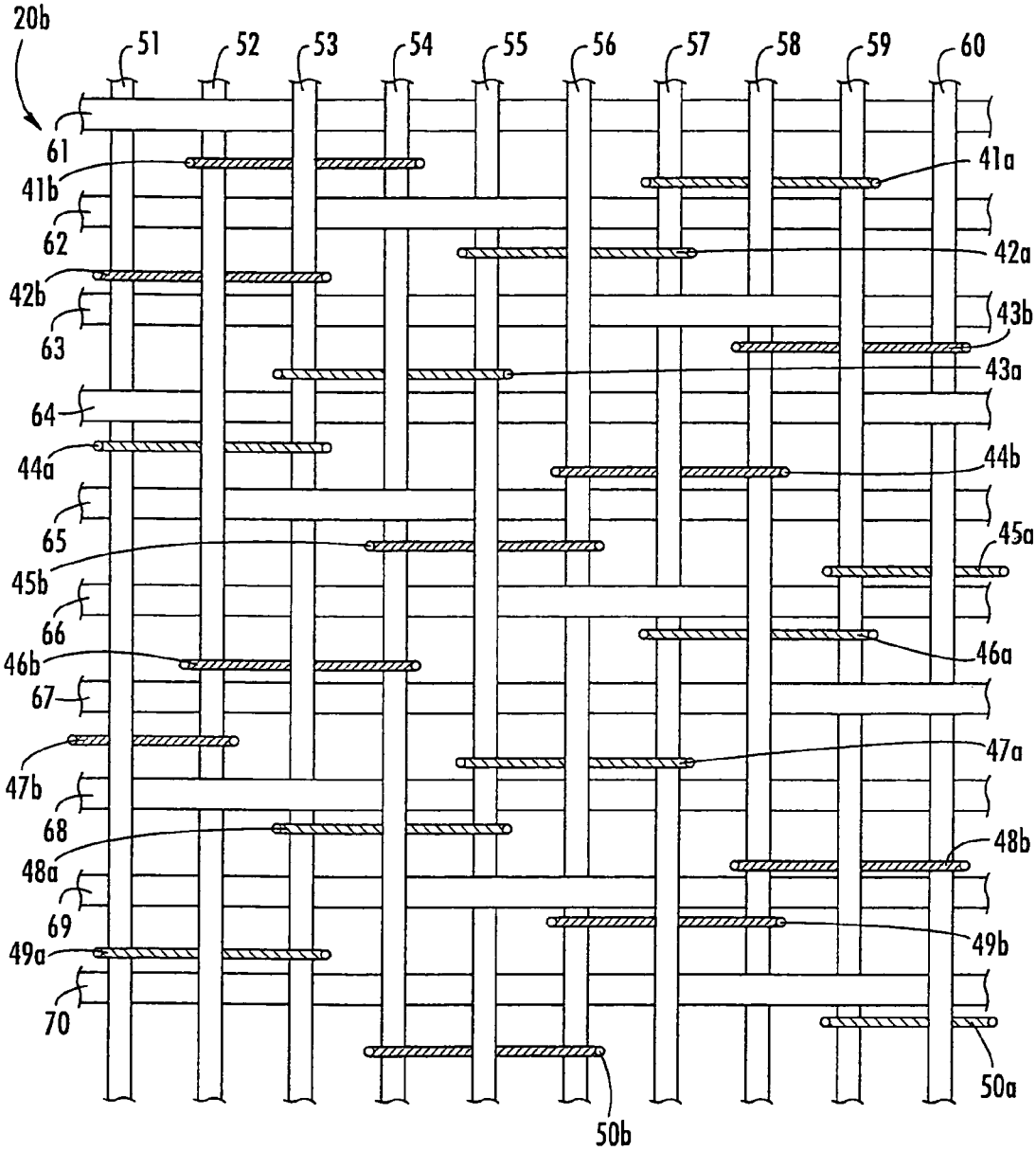
FIG. 2 is a top view of the bottom layer of the papermaker's fabric of FIG. 1.

Referring now to FIGS. 1, 2, 3A and 3B, a papermaker's forming fabric, designated broadly at 20, is illustrated therein. The papermaker's fabric 20 includes a top layer 20*a* (FIG. 1) and a bottom layer 20*b* (FIG. 2). Although FIGS. 1 and 2 only show a single repeat unit of the fabric 20, those of skill in the art will appreciate that in commercial-sized fabrics the repeat unit shown in FIGS. 1 and 2 would be repeated many times, in both the machine and cross machine directions, to form a large fabric suitable for use on a papermaking machine.

The top layer 20*a* is formed with ten top MD yarns sequentially designated at 21-30, ten top CMD yarns sequentially designated at 31-40, and portions of ten stitching yarn pairs designated sequentially at 41*a*, 41*b*-50*a*, 50*b*. Each top CMD yarn 31-40 interweaves with the top MD yarns 21-30 in an "under 1/over 2/under 1/over 2/under 1/over 3" pattern; thus, the floats formed by the top CMD yarn 31 over the top MD yarns 21-30 are non-uniform (i.e., at least one of the top CMD floats differs in length from the other top CMD floats). The weave pattern is exemplified in FIG. 3A, wherein the weave path for top CMD yarn 31 is illustrated. Top CMD yarn 31 passes under top MD yarn 21, over top MD yarns 22, 23, under top MD yarn 24, over top MD yarns 25, 26, under top MD yarn 27, and over top MD yarns 28, 29, 30.

The remaining top CMD yarns 22-30 follow a similar path through the top MD yarns 21-30 (in which they form non-uniform top CMD floats), but each is offset from its adjacent top CMD yarns by two top MD yarns. Thus, top CMD yarn 32 passes over top MD yarns 26, 27, 28 in its "over 3" float, while adjacent top CMD yarn 31 passes over top MD yarns 28, 29, 30 in its "over 3" float. As such, the "over 3" float of top CMD yarn 32 is offset by two top MD yarns from top CMD yarn 31. This offset of two top MD yarns continues with the ensuing top CMD yarns 33-40.

Figures 3A, 3B, 4A, 4B, 5A, 5B, 6A, 6B:
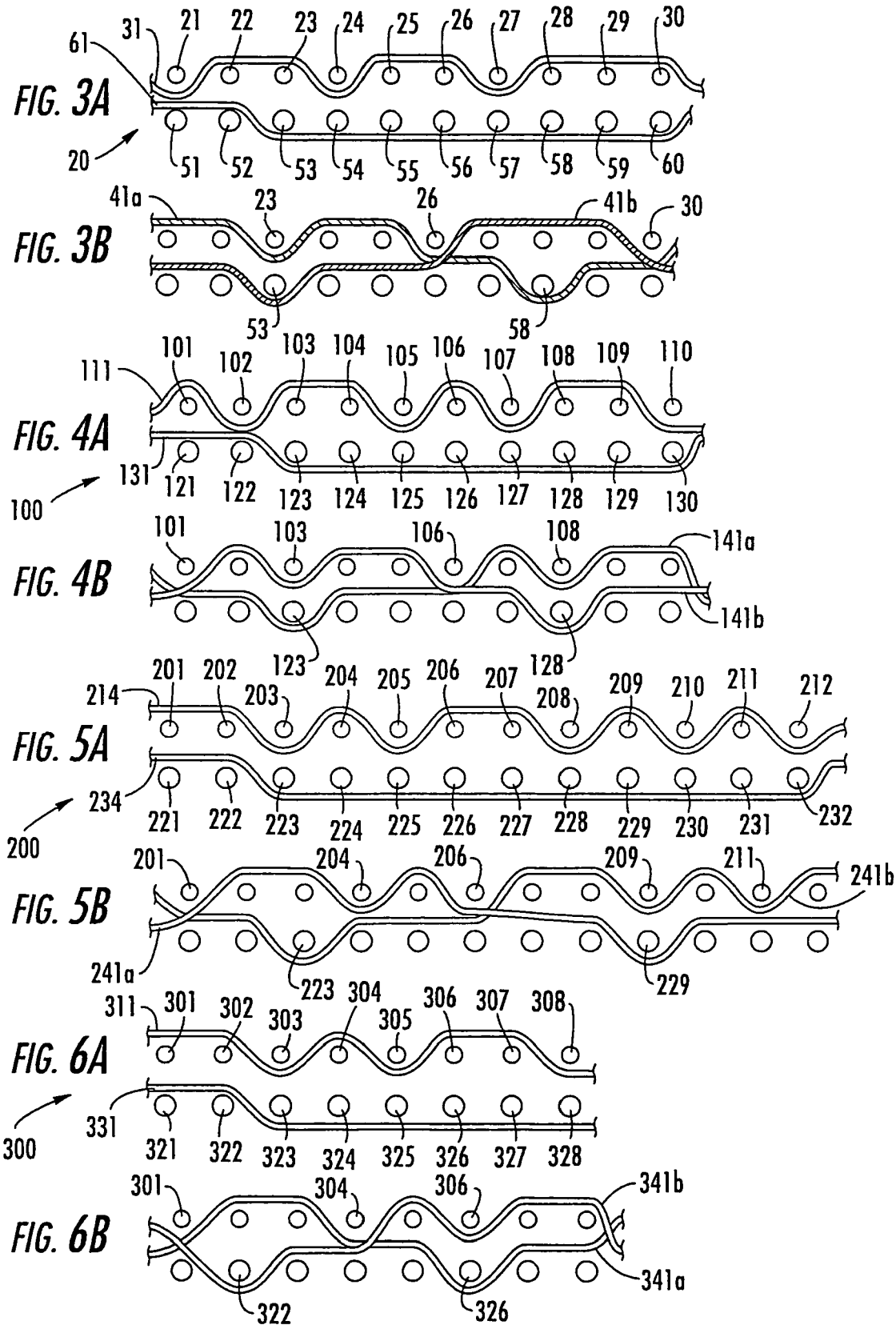
FIGS. 3A and 3B are section views taken along lines 3A-3A and 3B-3B, respectively, of FIG. 1 showing the weave path of typical top and bottom CMD yarns (FIG. 3A) and typical stitching yarns (FIG. 3B).
FIGS. 4A and 4B are section views of typical top and bottom CMD yarns (FIG. 4A) and typical stitching yarns (FIG. 4B) as they interweave with top and bottom MD yarns of a 20 harness papermaker's fabric according to other embodiments of the present invention.
FIGS. 5A and 5B are section views of typical top and bottom CMD yarns (FIG. 5A) and typical stitching yarns (FIG. 5B) as they interweave with top and bottom MD yarns of a 24 harness papermaker's fabric according to other embodiments of the present invention.
FIGS. 6A and 6B are section views of typical top and bottom CMD yarns (FIG. 6A) and typical stitching yarns (FIG. 6B) as they interweave with top and bottom MD yarns of a 16 harness papermaker's fabric according to other embodiments of the present invention.

Referring still to FIG. 1, the upper portions of the stitching yarn pairs 41*a*, 41*b*-50*a*, 50*b* also interweave with the top MD yarns as a top CMD yarn unit in an "under 1/over 2/under 1/over 2/under 1/over 3", with the upper portion of one stitching yarn of the pair forming the "over 3" float, and the upper portion of the other stitching yarn of the pair forming the "over 2/under 1/over 2" segment, thereby combining to form a top CMD yarn unit that matches the sequence of the top CMD yarns 31-40. For example, and as best seen in FIG. 3B, stitching yarn 41*a* passes over top MD yarns 21, 22, passes under top MD yarn 23, and passes over top MD yarns 24, 25 before passing below top MD yarn 26 as it travels to the bottom layer 20*b* of the fabric 20. Stitching yarn 41*b* passes over top MD yarns 27, 28, 29 before passing below top MD yarn 30 as it travels to the bottom layer 20*b*. Thus, together the upper portions of the stitching yarns 41*a*, 41*b* form the same "under 1/over 2/under 1/over 2/under 1/over 3" sequence followed by the top CMD yarns 31-40. Notably, the "under 1/over 2/under 1/over 2/under 1/over 3" sequence of the stitching yarns 41*a*, 41*b* is offset from the "under 1/over 2/under 1/over 2/under 1/over 3" sequence of the adjacent top CMD yarn 31 by one top MD yarn, such that the top CMD yarns and CMD yarn units form an integrated weave pattern.

This same "under 1/over 2/under 1/over 2/under 1/over 3" sequence is followed by the other stitching yarn pairs 42*a*, 42*b*-50*a*, 50*b*, but each is offset by from its adjacent top CMD yarns by one top MD yarn. Thus, for stitching yarn pair 42*a*, 42*b*, the "over 3" segment is formed by stitching yarn 42*b* over top MD yarns 25, 26, 27, whereas for adjacent top CMD yarn 32, the "over 3" segment is formed over top MD yarns 26, 27, 28 (the designations of the stitching yarns herein are such that all of the stitching yarns designated with an "a" form the "over 2/under 1/over 2" segment, and those designated with a "b" form the "over 3" segment).

The afore-described interweaving of the top CMD yarns and the stitching yarns with the top MD yarns forms a pattern in which each top CMD yarn and each top CMD yarn unit (formed by the combination of the upper portions of two stitching yarns of a pair) follows the "under 1/over 2/under 1/over 2/under 1/over 3" sequence, and each adjacent top CMD yarn or top CMD yarn unit is offset from its adjacent CMD yarn unit or top CMD yarn by one top MD yarn. This provides a papermaking surface to the top layer 20*a* that is entirely filled with yarns forming the "under 1/over 2/under 1/over 2/under 1/over 3" sequence, each offset by one top MD yarn.

It should also be noted that the stitching yarns 41*a*, 41*b*-50*a*, 50*b* are woven as "reversed picks". This term refers to the relative positions of the upper portions of adjacent stitching yarn pairs. The presence of reversed picks in a double-pick-stitched triple layer fabric can be established by locating transitional top MD yarns; these are the top MD yarns under which stitching yarns pass when transitioning from the top layer 20*a* to the bottom layer 20*b* or vice versa; for example, the transitional top MD yarns for the stitching yarns 41*a*, 41*b* are top MD yarns 26 and 30. Once the transitional top MD yarns for each stitching yarn pair are located, the most predominant diagonal (minimum step) formed by their intersection with the stitching yarns is identified (in this instance, the most prominent diagonal would be a diagonal line formed between an intersection K1 of stitching yarns 41*a*, 41*b* and top MD yarn 30, an intersection K2 of stitching yarns 42*a*, 42*b* and top MD yarn 28, an intersection K3 of stitching yarns 43*a*, 43*b* and top MD yarn 26, and so on). The positions of the stitching yarns on-each side of this diagonal relative to each other and to the top CMD yarn between them are examined. If the upper portions of successive stitch yarn pairs on one side of this diagonal are closer to each other (i.e., both are closer to the top CMD yarn between them than their respective paired yarns) in some cases and farther apart in others, then the fabric consists of at least some reversed picks.

To continue with the example above, following the imaginary diagonal line through intersections K1, K2, K3 discussed above, the segments of stitching yarn 41*b*, 42*b* that are located on the left side of the diagonal are farther apart from one another than the segments of stitching yarns 41*a*, 42*a* (in other words, stitching yarns 41*a*, 42*a* are woven directly adjacent top CMD yarn 32, whereas stitching yarns 41*b*, 42*b* are not directly adjacent top CMD yarn 32 because stitching yarns 41*a*, 42*a* are between them). Moving to the next sets of yarns along the diagonal, the segments of stitching yarns 42*b*, 43*b* located on the left side of the diagonal are closer to one another than are the segments of stitching yarns 42*a*, 43*a*. Thus, on the left side of the diagonal, the "farther" positions of stitching yarns 41*b*, 42*b* reversed to a "closer" position for stitching yarns 42*b*, 43*b*. As such, these yarns represent "reversed picks."

It has been discovered that by reversing the stitching yarns as discussed, marking that may be present on paper produced by the fabric due to the presence of diagonals such as that discussed above can be diminished. Although in the illustrated fabric 20 all of the stitching yarns are "reversed", those skilled in this art will appreciate that a lower percentage (such as 50, 40, 30, or 25 percent or the like) of the stitching yarn pairs may be reversed.

Referring now to FIG. 2, the bottom layer 20*b* of the fabric 20 includes ten bottom MD yarns 51-60, ten bottom CMD yarns 61-70 and the lower portions of the stitching yarns 41*a*, 41*b*-50*a*, 50*b*. Each bottom CMD yarn is interwoven with the bottom MD yarns 51-60 in an "over 2/under 8" sequence. This sequence is illustrated by bottom CMD yarn 61 (see FIG. 3B), which passes over bottom CMD yarns 51, 52, then passes under bottom CMD yarns 53-60 to form an 8-yarn float on the machine side of the fabric. Each adjacent bottom CMD yarn follows the same sequence, but is offset from its adjacent CMD yarns by three bottom MD yarns. For example, bottom CMD yarn 62, which is adjacent to bottom CMD yarn 61, passes over bottom MD yarns 24, 25, which are offset from bottom MD yarns 21, 22 (which are passed over by bottom CMD yarn 61) by three bottom MD yarns. This pattern is repeated for the remaining bottom CMD yarns 63-70.

Each of the stitching yarns 41*a*, 41*b*, 50*a*, 50*b* also passes below a bottom CMD yarn to stitch the top and bottom layers 20*a*, 20*b* together. Referring to FIGS. 2 and 3B, the stitching yarn 41*a* stitches below bottom MD yarn 68, and the stitching yarn 41*b* stitches under bottom MD yarn 63. The stitching position of stitching yarn 41*a* under bottom MD yarn 68 locates the stitch directly beneath the center yarn of the "under 3" segment of stitching yarn 41*b* (in this instance, that center yarn is top MD yarn 28). The stitching position of stitching yarn 41*b* under bottom MD yarn 63 locates the stitch directly beneath the central "under 1" yarn of the "over 2/under 1/over 2" segment of stitching yarn 41*a* (in this instance, the "under 1" yarn is top MD yarn 23). These positions may be changed in other embodiments of the fabric as desired.

Adjacent stitching yarn pair stitching locations are offset from one another by two bottom MD yarns. Thus, as shown in FIG. 2, stitching yarns 41*a*, 41*b* stitch below, respectively, bottom MD yarns 68, 63, while adjacent stitching yarns 42*a*, 42*b* stitch below, respectively, bottom MD yarns 66, 61. This offset is continued for the remainder of the repeat unit.

In the configuration described herein, it has been determined that the employment of non-uniform top CMD floats can improve the wear properties of the papermaking surface compared to fabrics that have a plain weave surface. The additional float length offered by the "over 2" and "over 3" floats can improve the wear characteristics of the fabric by providing additional CMD surface area for wear. The similarity between the non-uniform floats (i.e., they differ in length by only one yarn) can reduce any marking or other difference in performance that might otherwise occur when floats of different lengths are used. At the same time, the absence of an inordinately long CMD float within a yarn on the papermaking surface can assist in avoiding marking of the paper that might otherwise occur. The presence of 2- and 3-yarn floats on the papermaking surface can provide a sufficiently coplanar surface for some types of paper, particularly tissue paper. The illustrated configuration can be employed with a 20 harness triple layer fabric, which, if it were to have a uniform float repeat for each yarn in a non-plain weave fabric, would be limited to floats of 4 and 9 yarns, each of which is likely to have significant diagonal marking. Thus, if a weaver has a 20 harness loom available, a fabric of the illustrated weave pattern can produce acceptable tissue paper with improved wear properties.

Those skilled in this art will appreciate that the weave pattern may be modified from that illustrated and described. For example, the stitching yarns may be woven as traditional, rather than reversed, picks, and/or one of the stitching yarns may be woven with the bottom layer while the other is not (a so-called "phantom stitch" construction). Also, the stitching yarns may be woven after every two or every three top CMD yarns rather than after every top CMD yarn. Moreover, the stitching yarns may not be present in pairs, but instead may be present as single stitching yarns positioned between adjacent top CMD yarns. Also, the top and bottom CMD yarns may be offset from one another by a different number of top MD yarns.

The bottom layer weave pattern may also be modified in many ways. For example, more or fewer bottom CMD yarns may be included, the stitching yarns may stitch at different locations, and/or the bottom MD and CMD yarns may be woven in different patterns. Exemplary alternative bottom layer weave patterns are shown in U.S. Pat. Nos. 6,244,306; 5,967,195; and 6,253,796, the disclosures of each of which are hereby incorporated herein in their entireties.

Referring now to FIGS. 4A and 4B, exemplary yarns of another embodiment of a 20 harness fabric, designated broadly at 100, is illustrated therein. The fabric 100 includes ten top MD yarns 101-110 and ten bottom MD yarns 121-130. The top MD yarns 101-110 are interwoven with top CMD yarns (one of which is designated at 111 and shown in FIG. 4A) such that the top CMD yarns follow an "over 1/under 1/over 2/under 1/over 1/under 1/over 2/under 1" sequence that includes non-uniform top CMD floats. More specifically, top CMD yarn 111 passes over top MD yarn 101, under top MD yarn 102, over top MD yarns 103, 104, under top MD yarn 105, over top MD yarn 106, under top MD yarn 107, over top MD yarns 108, 109, and under top MD yarn 110. Thus, the top CMD yarn 111 forms non-uniform floats over the top MD yarns. The bottom MD yarns 121-130 are interwoven with the bottom CMD yarns (one of which is designated at 131 and shown in FIG. 4A) such that the bottom CMD yarn follows an "over 2/under 8" pattern like that of the bottom CMD yarns of the fabric 20 shown in FIGS. 1-3B.

The fabric 100 also includes stitching yarn pairs (one of which is illustrated in FIG. 3B and designated therein at 141*a*, 141*b*) that are interwoven with the top MD yarns 101-110 and the bottom MD yarns 121-130. The upper portion of the stitching yarn 141*a* follows an "over 1/under 1/over 2" pattern with top MD yarns 131-134 before traveling under the top MD yarns to stitch with bottom MD yarn 138, and the upper portion of the stitching yarn 141*b* follows a similar "over 1/under 1/over 2" pattern with the top MD yarns 136-139 before traveling under the top MD yarns to stitch with bottom MD yarn 133. Thus, together the upper portions of the stitching yarns 141*a*, 141*b* form a single top CMD yarn unit that follows the "over 1/under 1/over 2/under 1/over 1/under 1/over 2/under 1" pattern of the top CMD yarns in the same serial order.

Those skilled in this art will appreciate that adjacent top CMD yarns, stitching yarns, and bottom CMD yarns will be offset from one another to form a suitable integrated weave pattern. For example, adjacent top CMD yarns may be offset by two top MD yarns, stitching yarn pairs may be offset from each other by two top MD yarns and from adjacent top CMD yarns by one top MD yarn, and adjacent bottom CMD yarns may be offset from each other by three bottom MD yarns. Other patterns and offsets may also be suitable.

Similar to the fabric embodiments described in connection with FIGS. 1-3B above, the fabric 100 also includes top CMD yarns with some non-single CMD floats that can increase wear on the papermaking surface, and can do so without significant diagonal marking.

The general concept of non-uniform top CMD floats demonstrated by the fabrics 20 and 100 above can also be utilized in fabrics woven on different numbers of harnesses. For example, a 24 harness fabric embodiment designated broadly at 200 is illustrated in FIGS. 5A and 5B. The fabric 200 includes twelve top MD yarns 201-212, twelve bottom MD yarns 221-232, top CMD yarns (one of which is designated at 214 in FIG. 5A), bottom CMD yarns (one of which is designated at 234 in FIG. 5A), and stitching yarn pairs (one of which includes stitching yarns designated at 241*a*, 241*b* in FIG. 5B). In this embodiment, the top CMD yarns interweave with the top MD yarns in an "over 2/under 1/over 1/under 1/over 2/under 1/over 1/under 1/over 1/under 1" sequence (see FIG. 5A), and the upper portions of the stitching yarns combine to form a top CMD yarn unit with a similar sequence (see FIG. 5B). The bottom CMD yarns interweave with the bottom MD yarns in an "over 2/under 10" sequence (FIG. 5A), and each stitching yarn passes below one bottom MD yarn (FIG. 5B).

As another example, a 16 harness fabric embodiment designated broadly at 300 is illustrated in FIGS. 6A and 6B. The fabric 300 includes eight top MD yarns 301-308, eight bottom MD yarns 321-328, top CMD yarns (one of which is designated at 311 in FIG. 6A), bottom CMD yarns (one of which is designated at 331 in FIG. 6A), and stitching yarn pairs (one of which includes stitching yarns 341*a*, 341*b* in FIG. 6B). In this embodiment, the top CMD yarns interweave with the top MD yarns in an "over 2/under 1/over 1/under 1/over 2/under 1" sequence (see FIG. 6A), and the upper portions of the stitching yarns combine to form a top CMD yarn unit with a similar sequence (see FIG. 6B). The bottom CMD yarns interweave with the bottom MD yarns in an "over 2/under 6" sequence (FIG. 6A), and each stitching yarn passes below one bottom MD yarn (FIG. 6B).

Each of the embodiments described above may provide improved papermaking surface wear over a plain weave fabric, and may provide improved marking performance over fabrics with longer top CMD floats. As shown in the illustrated embodiments, the non-uniform CMD floats may differ from one another by one top MD yarn (i.e., the floats for a single top CMD yarn will be a combination of 2-yarn floats and 3-yarn floats, or a combination of 1-yarn floats and 2-yarn floats), as this can reduce performance differences in different portions of the fabric and reduce marking of the paper.

The fabrics illustrated and otherwise described and claimed herein may be employed in a variety of applications, including forming fine paper grades, tissue paper, brown paper and newsprint, but may be especially beneficial for tissue paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top MD yarns, the top CMD yarns and the stitching yarns is between about 0.10 and 0.22 mm, the diameter of the bottom MD yarns is between about 0.14 and 0.27 mm, and the diameter of the bottom CMD yarns is between about 0.18 and 0.50 mm. Those of skill in the art will appreciate that yarns having diameters outside the above ranges may be used in certain applications.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. In particular, paper stock suitable for forming tissue paper may be employed. As the details of how the paper stock is applied to the forming fabric and how moisture is removed from the paperstock is well understood by those of skill in the art, additional details regarding this aspect of the present invention need not be provided herein.

The foregoing embodiments are illustrative of the present invention, and are not to be construed as limiting thereof. The invention is defined by the following claims, with equivalents of the claims to be included therein.

What is claimed is:

1. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

a plurality of stitching yarns interwoven with the top and bottom fabric layers;

the top machine direction yarns, top cross machine direction yarns, bottom machine direction yarns, bottom cross machine direction yarns, and stitching yarns being interwoven as a series of repeat units, wherein in each of the repeat units, each top cross machine direction yarn forms multiple paper side floats or knuckles by passing over some of the top machine direction yarns and interweaving beneath a top machine direction yarn on each side of the float or knuckle, and wherein at least a first of the paper side floats or knuckles passes over a first number of top machine direction yarns, and at least a second of the paper side floats or knuckles passes over a second number of top machine direction yarns, and the difference between the first number and the second number is one; and wherein each of the top cross machine direction yarns follows the same weaving sequence with respect to the top machine direction yarns as each of the other top cross machine direction yarns.

2. The papermaker's triple layer fabric defined in claim 1, wherein the set of top machine direction yarns of each repeat unit comprises ten top machine direction yarns.

3. The papermaker's triple layer fabric defined in claim 2, wherein each top cross machine direction yarn forms two floats that pass over two top machine direction yarns and a third float that passes over three top machine direction yarns.

4. The papermaker's triple layer fabric defined in claim 2, wherein each top cross machine direction yarn forms two floats that pass over two top machine direction yarns and two floats knuckles that pass over one top machine direction yarn.

5. The papermaker's triple layer fabric defined in claim 1, wherein the set of top machine direction yarns of each repeat unit comprises twelve top machine direction yarns.

6. The papermaker's triple layer fabric defined in claim 5, wherein each top cross machine direction yarn forms two floats that pass over two top machine direction yarns and three knuckles that pass over one top machine direction yarn.

7. The papermaker's triple layer fabric defined in claim 1, wherein the set of top machine direction yarns of each repeat unit comprises eight top machine direction yarns.

8. The papermaker's triple layer fabric defined in claim 7, wherein each top cross machine direction yarn forms two floats that pass over two top machine direction yarns and a third knuckle that passes over one top machine direction yarn.

9. The papermaker's triple layer fabric defined in claim 1, wherein a pair of first and second stitching yarns is positioned between adjacent pairs of top cross machine direction yarns, the first and second stitching yarns of each pair being interwoven with the top and bottom machine direction yarns such that, as an upper portion of the first stitching yarn is interweaving with the top machine direction yarns, a binding portion of the second stitching yarn is positioned below the top machine direction yarns, and such that as an upper support portion of the second stitching yarn is interweaving with the top machine direction yarns, a binding portion of the first stitching yarn is positioned below the top machine direction yarns, and such that the first and second stitching yarns cross each other as they pass below a transitional top machine direction yarn, and such that at least one of the binding portions of the first and second stitching yarns passes below at least one of the bottom machine direction yarns.

10. The papermaker's triple layer defined in claim 9, wherein a pair of first and second stitching yarn pairs is positioned between each adjacent pair of top machine direction yarns.

11. The papermaker's triple layer fabric defined in claim 10, wherein the upper portions of the first and second stitching yarns form paper side floats over the top machine direction yarns in the same serial order as top cross machine direction yarns such that they integrate with the weave pattern of the top layer.

12. The papermaker's triple layer fabric defined in claim 11, wherein each float of a top CMD yarn of the first length is offset from a float or knuckle of a stitching yarn of the first length by one top MD yarn.

13. The papermaker's triple layer fabric defined in claim 1, wherein each bottom cross machine direction yarn passes above two adjacent bottom machine direction yarns and passes below the remaining bottom machine direction yarns to form a machine side float or knuckle.

14. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

a plurality of stitching yarn pairs interwoven with the top and bottom fabric layers;

the top machine direction yarns, top cross machine direction yarns, bottom machine direction yarns, bottom cross machine direction yarns, and stitching yarns being interwoven as a series of repeat units, wherein in each of the repeat units, each top cross machine direction yarn passes forms multiple paper side floats or knuckle by passing over some of the top machine direction yarns and interweaving beneath a top machine direction yarn on each side of the float or knuckle, the floats or knuckles being non-uniform for each top cross machine direction yarn, and each stitching yarn pair forms a cross machine direction yarn unit having multiple paper side floats by passing over some of the top machine direction yarns and interweaving beneath a top machine direction yarn on each side of each float or knuckle, the floats or knuckles being non-uniform for each cross machine direction yarn unit; and wherein each of the top cross machine direction yarns follows the same weaving sequence with respect to the top machine direction yarns as each of the other top cross machine direction yarns.

15. The papermaker's triple layer fabric defined in claim 14, wherein each of the top cross machine direction yarn and each cross machine direction yarn unit is offset from its adjacent top cross machine direction yarn or cross machine direction yarn unit by one top machine direction yarn.

16. The papermaker's triple layer fabric defined in claim 14, wherein the fabric includes ten top machine direction yarns and ten bottom machine direction yarns in each repeat unit.

17. The papermaker's triple layer fabric defined in claim 14, wherein the fabric includes ten top machine direction yarns and ten bottom machine direction yarns.

18. The papermaker's triple layer fabric defined in claim 16, wherein each top cross machine direction yarn forms two floats that pass over two top machine direction yarns and two knuckles that passes over one top machine direction yarns.

19. The papermaker's triple layer fabric defined in claim 14, wherein each top cross machine direction yarns of each repeat unit comprises twelve top machine direction yarns.

20. The papermaker's triple layer fabric defined in claim 19, wherein each top cross machine direction yarn forms two floats that pass over two top machine direction yarns and three knuckles that pass over one top machine direction yarn.

21. The papermaker's triple layer fabric defined in claim 14, wherein the set of top machine direction yarns of each repeat unit comprises eight top machine direction yarns.

22. The papermaker's triple layer fabric defined in claim 21 wherein each top cross machine direction yarn forms two floats that pass over two top machine direction yarns and a knuckle float that passes over one top machine direction yarn.

23. The papermaker's triple layer fabric defined in claim 14, wherein each float of a top CMD yarn of a first length is offset from a float or knuckle of a stitching yarn of the first length by one top MD yarn.

24. A method of making paper, comprising the steps of:

(a) providing a triple layer papermaker's forming fabric, the fabric comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

a plurality of stitching yarns interwoven with the top and bottom fabric layers;

the top machine direction yarns, top cross machine direction yarns, bottom machine direction yarns, bottom cross machine direction yarns, and stitching yarns being interwoven as a series of repeat units, wherein in each of the repeat units, each top cross machine direction yarn passes forms multiple paper side floats or knuckles by passing over some of the top machine direction yarns and interweaving beneath a top machine direction yarn on each side of the float, and wherein at least a first of the paper side floats or knuckles passes over a first number of top machine direction yarns, and at least a second of the paper side floats or knuckles passes over a second number of top machine direction yarns, and the difference between the first number and the second number is one; and wherein each of the top cross machine direction yarns follows the same weaving sequence with respect to machine direction yarn as each of the other top cross machine direction yarns;

(b) applying paper stock to the fabric; and (c) removing moisture from the paper stock to form paper.

25. The method defined in claim 24, wherein the paper stock is selected and applied such that the paper formed is tissue paper.

* * * * *

UNITED STATES PATENT AND TRADEMARK OFFICE

CERTIFICATE OF CORRECTION

PATENT NO. : 7,484,538 B2
APPLICATION NO. : 11/513590
DATED : February 3, 2009
INVENTOR(S) : Barratte It is certified that error appears in the above-identified patent and that said Letters Patent is hereby corrected as shown below:

Title page 2, Item 56, and Col. 1, Line 1,
Please Delete Ref. "4,363,426 A 12/ 1982 Heinzl et al."

Column 11, Claim 12, Line 43:
Please correct "float of a"
To read -- float or knuckle of a --

Column 11, Claim 14, Line 67:
Please correct "floats or knuckle by"
To read -- floats or knuckles by --

Column 12, Claim 15, Line 17:
Please correct "wherein each of the top"
To read -- wherein each top --

Column 12, Claim 17, Lines 25-27:
Please correct Claim 17 to read -- The papermaker's triple layer fabric defined in Claim 17, wherein each top cross machine direction yarn forms two floats that pass over two top machine direction yarns and a third float that passes over three top machine direction yarns --

Column 12, Claim 19, Line 33:
Please correct "wherein each top cross machine"
To read -- wherein the set of top machine --

Column 12, Claim 23, Line 46:
Please correct "wherein each float of"
To read -- wherein each float or knuckle of --

Column 14, Claim 24, Lines 2-3:
Please correct "respect to machine direction yarn as"
To read -- respect to the top machine direction yarns as --

Signed and Sealed this

Eleventh Day of May, 2010

David J. Kappos

David J. Kappos
*Director of the United States Patent and Trademark Office*